US006941583B2

(12) United States Patent
Yan

(10) Patent No.: US 6,941,583 B2
(45) Date of Patent: Sep. 13, 2005

(54) ILLUMINATED HEADWEAR

(76) Inventor: Suen Ching Yan, 17145 Margay Ave., Carson, CA (US) 90746

( * ) Notice: Subject to any disclaimer, the term of this patent is extended or adjusted under 35 U.S.C. 154(b) by 218 days.

(21) Appl. No.: 10/612,023

(22) Filed: Jul. 1, 2003

(65) Prior Publication Data

US 2005/0066422 A1 Mar. 31, 2005

(51) Int. Cl.[7] ..... A42B 1/24
(52) U.S. Cl. ..... 2/209.13; 362/106
(58) Field of Search ..... 2/209.13; 362/103, 362/105, 106, 107

(56) References Cited

U.S. PATENT DOCUMENTS

| | | | | | |
|---|---|---|---|---|---|
| 2,640,980 | A | * | 6/1953 | Prupis | 340/321 |
| 2,788,439 | A | * | 4/1957 | Hesse | 362/310 |
| 3,032,647 | A | | 5/1962 | Wansky et al. | |
| 3,358,137 | A | * | 12/1967 | Fraser | 362/106 |
| 3,749,902 | A | * | 7/1973 | Drew | 362/106 |
| 4,090,232 | A | * | 5/1978 | Golden | 362/106 |
| 4,186,429 | A | * | 1/1980 | Johnston | 362/106 |
| 4,991,068 | A | | 2/1991 | Mickey | 362/103 |
| D318,338 | S | | 7/1991 | Mitchell | D26/39 |
| 5,404,593 | A | | 4/1995 | Kronenberger | 2/195 |
| 5,510,961 | A | | 4/1996 | Peng | 362/106 |
| 5,541,816 | A | | 7/1996 | Miserendino | 362/103 |
| 5,680,718 | A | | 10/1997 | Ratcliffe et al. | 40/329 |
| 5,741,060 | A | | 4/1998 | Johnson | 362/106 |
| 5,845,987 | A | | 12/1998 | Painter | 362/206 |
| D407,187 | S | | 3/1999 | Makki | D2/866 |
| 6,032,293 | A | | 3/2000 | Makki | 2/209.13 |
| 6,056,413 | A | | 5/2000 | Urso | 362/106 |
| 6,168,286 | B1 | | 1/2001 | Duffy | 362/106 |
| 6,244,721 | B1 | * | 6/2001 | Rodriguez et al. | 362/106 |
| 6,328,454 | B1 | * | 12/2001 | Davis | 362/105 |
| 6,461,015 | B1 | * | 10/2002 | Welch | 362/103 |
| 2002/0118533 | A1 | | 8/2002 | Marston | 362/106 |
| 2002/0159249 | A1 | | 10/2002 | Mickey | 362/106 |

FOREIGN PATENT DOCUMENTS

| | | |
|---|---|---|
| EP | EP 1 072 204 A2 | 1/2001 |

* cited by examiner

*Primary Examiner*—Katherine M Moran
(74) *Attorney, Agent, or Firm*—Cislo & Thomas LLP

(57) ABSTRACT

The present invention is a small, simple, low-cost lighted headwear system including headwear including a crown, and an illuminating device configured to couple to the crown of the headwear.

13 Claims, 5 Drawing Sheets

ILLUMINATED HEADWEAR

BACKGROUND OF THE INVENTION

1. Field of the Invention

This invention relates generally to lighted headwear, and more particularly to lighted headwear that may be used for ornamental or safety reasons.

2. Description of the Related Art

Many different ornamental and safety lighting systems are available However, the available systems may have limitations, including size, complexity, cost and appearance. What is needed is a small, simple, low-cost lighted headwear system.

SUMMARY OF THE INVENTION

The present invention is a small, simple, low-cost lighted headwear system including headwear including a crown, and an illuminating device configured to couple to the crown of the headwear.

DESCRIPTION OF THE PREFERRED EMBODIMENT(S)

The detailed description set forth below in connection with the appended drawings is intended as a description of presently preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention as set forth in the independent claims.

Figures 1, 2:
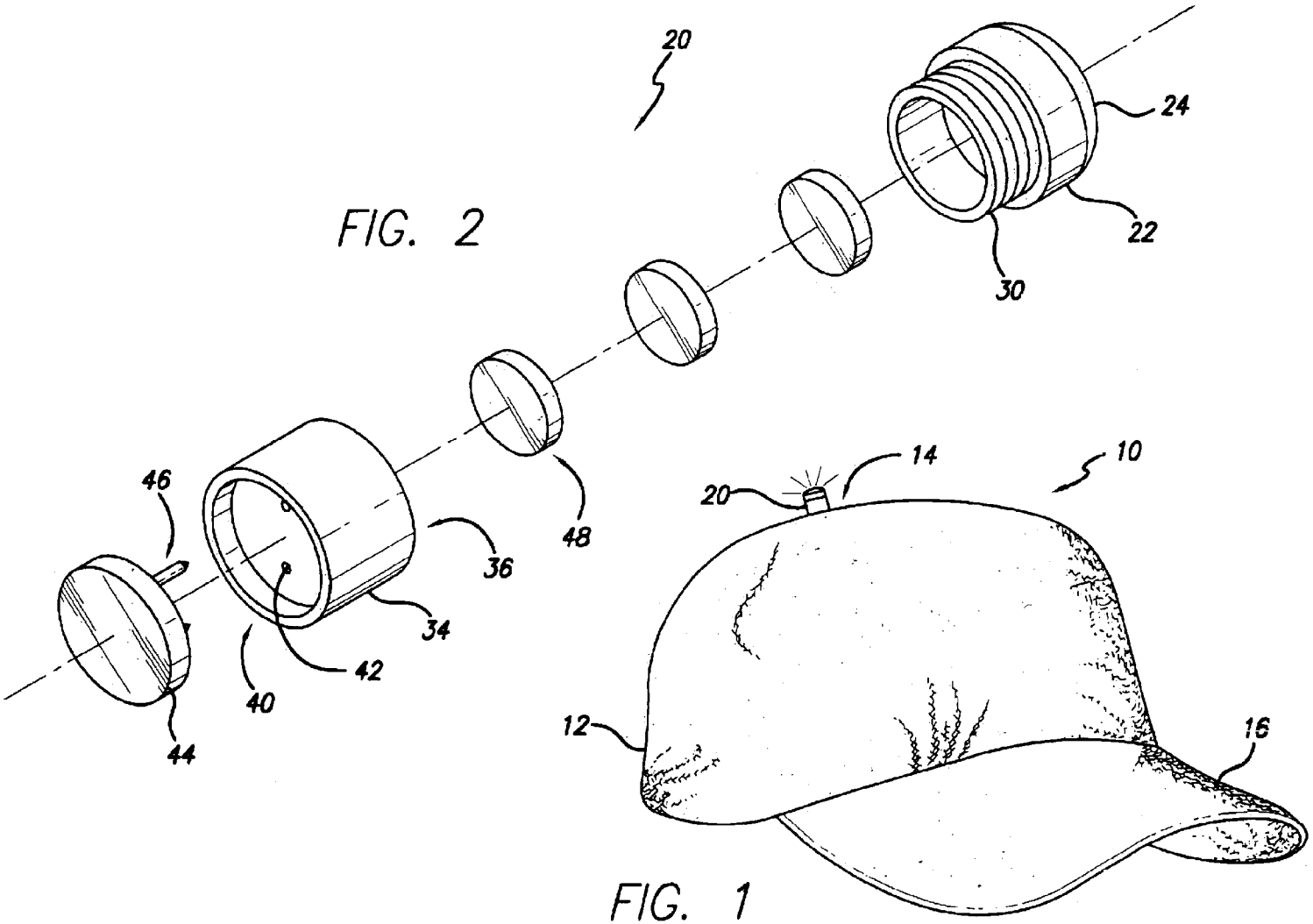
FIG. 1 is a perspective view of a lighted headwear system according to one embodiment of the present invention.
FIG. 2 is an exploded view of an illuminating device according one embodiment of the present invention.

A lighted headwear system according to the present invention is shown in FIG. 1, generally at 10. Lighted headwear system 10 typically includes headwear 12 and an illuminating device 20. Headwear 12 typically includes a crown 14 and bill 16. Headwear 12 is shown as a typical baseball style cap, however, it would be appreciated that headwear 12 could be many other types of headwear including helmets, and the like. Illuminating device 20 is typically coupled to headwear 12 at the crown 14, typically where the button of the baseball style cap would be. However, it will be appreciated that illuminating device 20 may be coupled to headwear 12 in many locations and may be used at any time—day or night time.

Illuminating device 20 is typically a cylindrical shape, being 0.25–1.0 inches in height and 0.25–1 inch in diameter and may emit light 360° about its circumference.

FIG. 2 shows an illuminating device 20 according to one embodiment of the present invention. Illuminating device 20 typically includes, a top housing 22 that is configured to couple to a bottom housing 34, which in turn is configured to couple to a base 44. Top housing 22 typically includes a translucent portion 24, which allows the illumination from an illuminating element 26 to pass therethrough. Top housing 22 also typically includes a top housing coupling portion 30 that is configured to couple to bottom housing 34.

Bottom housing 34 typically includes a recess 36 configured to receive power elements 48. Bottom housing 34 also includes a bottom coupling portion 40 which is configured to couple to base 44. Bottom coupling portion 40 typically includes apertures 42 configured to couple to base coupling portion 46 to couple base 44 to bottom housing 34.

Power elements 48 are typically batteries, but may be other types of devices that can deliver power to the illuminating device. It will be appreciated that although three power elements are shown, any number of power elements may be used to power illuminating device, as desired.

Figure 3:
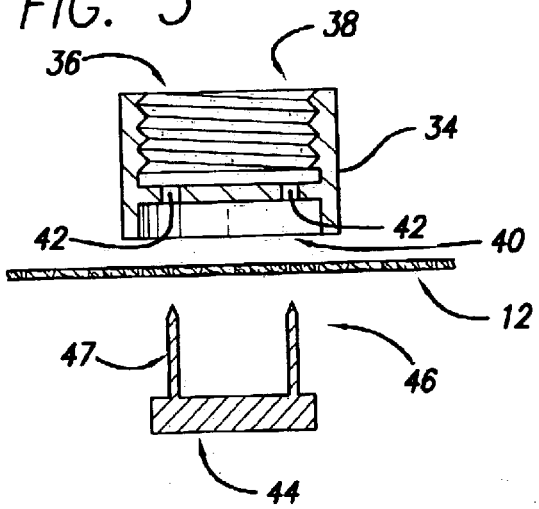
FIG. 3 is a plan view of an illuminating device including a bottom housing and base according to, an embodiment of the present invention.

FIG. 3 shows portions of the illuminating device in FIG. 2, along with a portion of headwear 12. Bottom housing 34 again includes recess 36, as well as top coupling portion 38 that is configured to couple to the top portion. Top coupling portion 38 is typically threaded to receive top housing coupling portion 30 of top housing 22. It will be appreciated that even though top housing coupling portion 30 and top coupling portion 38 are shown as thread and screw type elements, many other coupling configurations may be used, as desired.

Bottom housing 34 again includes a bottom coupling portion 40, which in turn again includes apertures 42. Base 44 includes a base coupling portion 46. Base coupling portion 46 typically includes prongs 47 that are configured to fit into apertures 42 of bottom coupling portion 40 to couple to bottom housing 34 and base 44. It will be appreciated that many coupling configurations may be used to couple bottom housing 34 to base 44.

Base 44 is typically placed on the inside of headwear 12, such that prongs 47 will extend through headwear 12 and couple base 44, headwear 12, and bottom housing 34. With this configuration, illuminating device 20 may be coupled to headwear 12, however, it will be appreciated that many other coupling configurations may be utilized.

Figure 4:
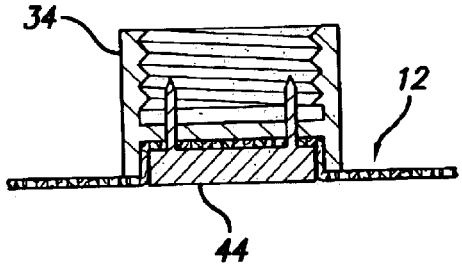
FIG. 4 shows an illuminating device coupled to headwear according to the embodiment in FIG. 3.

FIG. 4 shows a bottom housing 34 and base 44, along with headwear 12 in a coupled position. Base 44 has base coupling portion 46 and prongs 47 that extend through headwear 12 and into bottom coupling portion 40 of bottom housing 34 to couple them.

Figure 5:
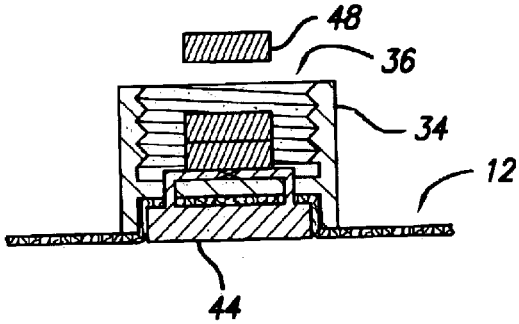
FIG. 5 shows the addition of power elements to the embodiment in FIG. 4.

FIG. 5 shows the embodiment in FIG. 4, with the addition of power elements 48. Power elements 48 typically fit into recess 36 of bottom housing 34. When power elements 48 are disposed within bottom housing 34, they may be forced down to bend prongs 47 to secure base 44 to bottom housing 34, thereby securing these portions of illuminating device 20 to headwear 12. Prongs 47 may be bent back to allow decoupling of the items.

Figure 6:
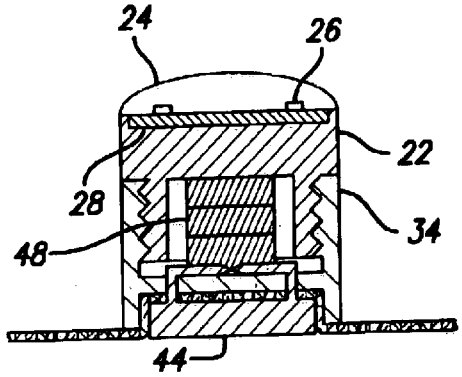
FIG. 6 shows the addition of a top housing to the embodiment in FIG. 5.

FIG. 6 shows the embodiment of FIG. 5 with the addition of top housing 22. Top housing 22 typically includes a translucent portion 24, illuminating element 26, and control circuit 28. Power elements 48 are typically configured to power control circuit 28 and illuminating elements 26. Translucent portion 24 is configured to allow viewing of illuminating elements 26 from most, if not all, directions.

Illuminating elements 26 are typically light-emitting diodes (LED), however, other illuminating elements may be used, as desired. Control circuit 28 is typically powered by power elements 48, and controls the operation of the overall system, including when illuminating elements 26 are illuminated.

Top housing 22 typically includes a top housing coupling portion 30 configured to couple to top coupling portion 38 of bottom housing 34. To energize control circuit 28 from power elements 48, top housing 22 is typically screwed down tighter, and loosened when power is to be disconnected. It will be appreciated that other configurations may be utilized to turn power on and off to control circuit 28 and illuminating element 26, including an actuator or switch configuration.

Figure 7:
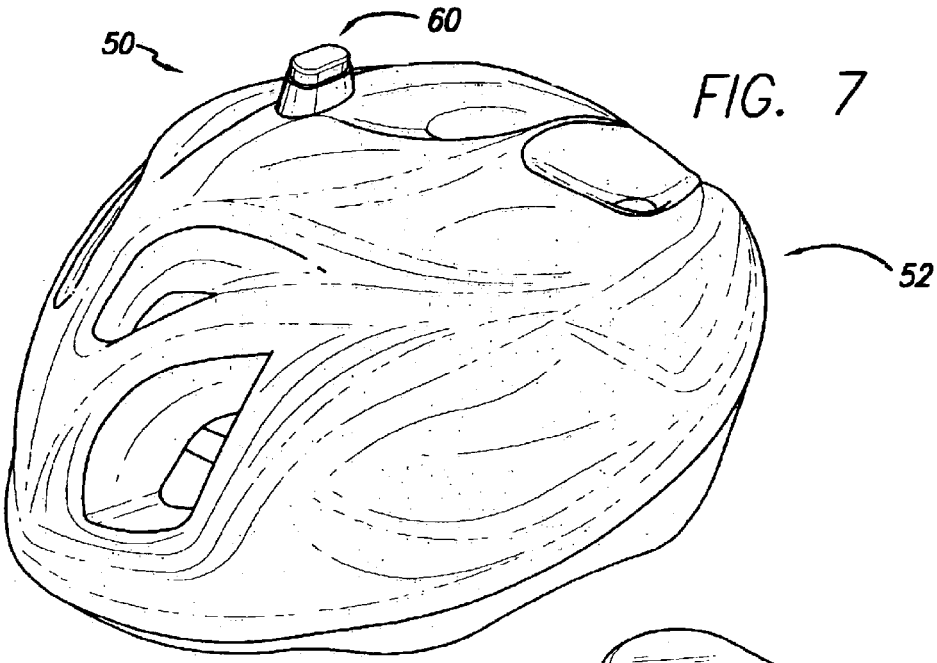
FIG. 7 is a perspective view of lighted headwear according to another embodiment of the present invention.

FIG. 7 is another embodiment of a lighted headwear system 50, according to the present invention. Lighted headwear system 50 typically includes headwear 52 and illuminating device 60. In this embodiment, headwear 52 is a bicycle helmet, but other types of headwear may be used, as desired. FIG. 7 also shows an alternative embodiment of an illuminating device.

Figure 8:
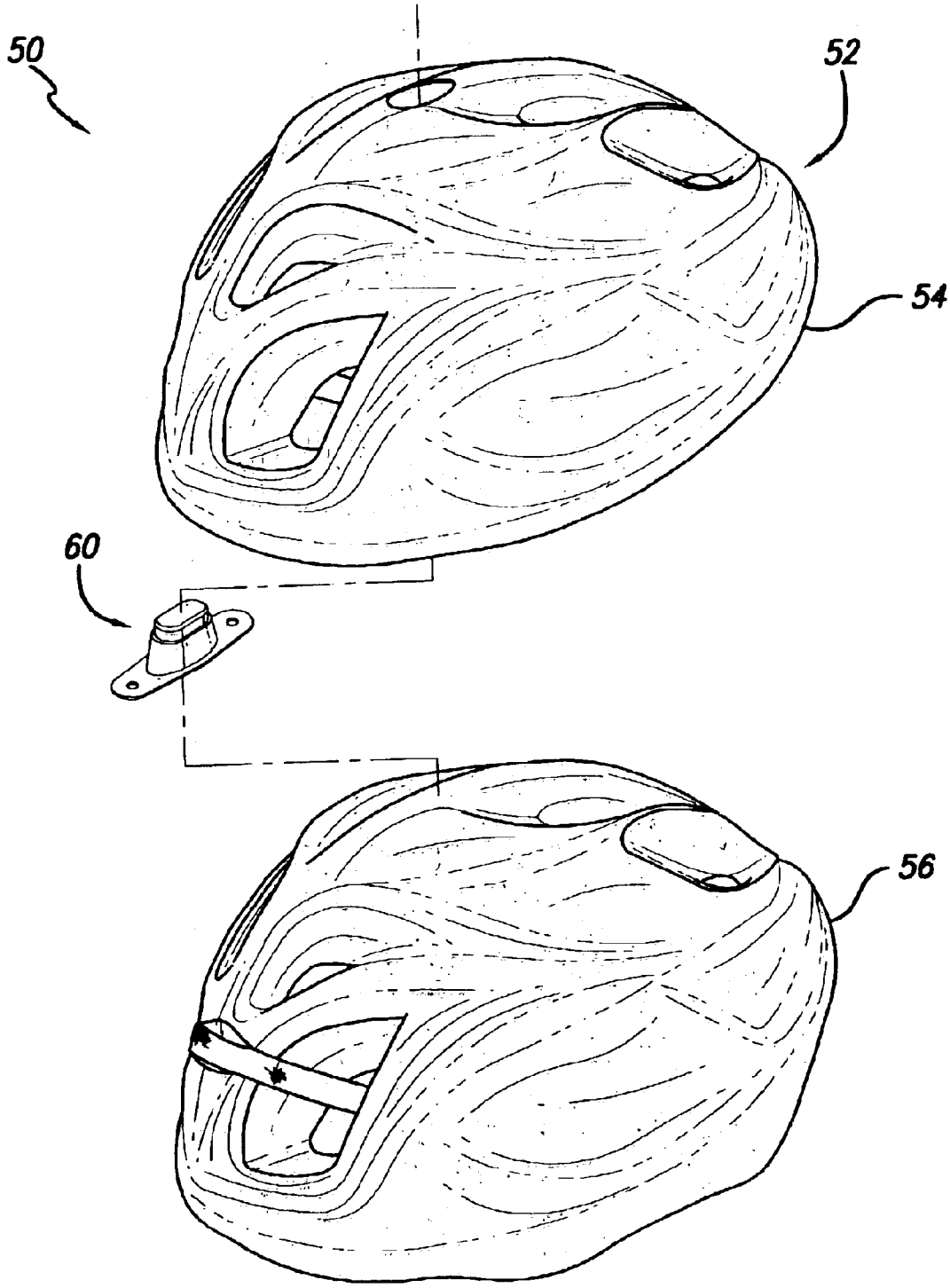
FIG. 8 shows an exploded d view of lighted headwear according to the embodiment in FIG. 7.

FIG. 8 shows an exploded view of lighted headwear system 50. In this embodiment, illuminating device 60 may fit between shell 54 and force dampening portion 56 of headwear 52. With this configuration, connecting structure 74 of bottom housing 70 is disposed between shell 54 and force dampening portion 56 to couple illuminating device 60 to headwear 52, however, other coupling configurations may be used, as desired.

Figure 9:
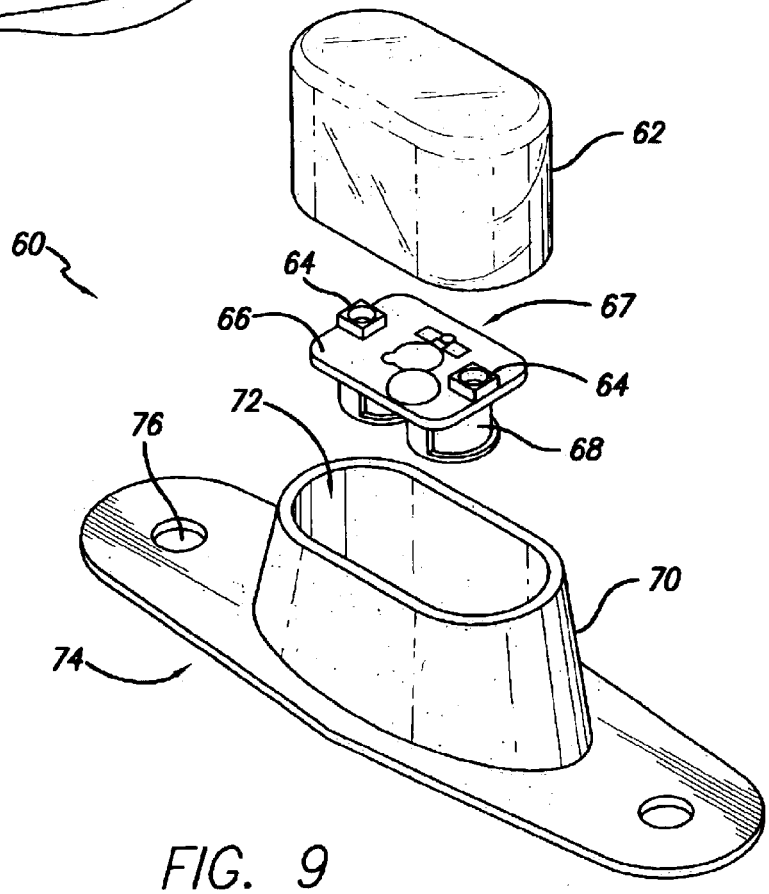
FIG. 9 is an exploded view of an illuminating device according to another embodiment of the present invention.

FIG. 9 shows an illuminating device 60, according to another embodiment of the present invention. Illuminating device 60 again typically includes a top housing 62 and a bottom housing 70. Top housing 62 typically includes an illuminating element 64, a control circuit 66 and power elements 68. Bottom housing 70 typically includes a recess 72 that allows illuminating element 64, control circuit 66 and power elements 68 to be disposed therein.

Illuminating device 60 is typically 1–4 inches long, by 0.25–2.0 inches wide, and 0.25–2.0 inches in height. It will be appreciated that the dimensions and configuration of illuminating device may vary, as desired.

Top housing 62 is typically configured to fit into recess 72, forming an interference fit to hold the other elements of the system therein, and to provide easy disassembly. Furthermore, top housing 62 is typically translucent to allow illumination from illuminating element 64 to pass therethrough. The control circuit 66 may be activated by pressing down on top housing 62 to activate switch 67 to alternately turn on and off power to control circuit 66, however, it will be appreciated that other activation configurations may be utilized, as desired. Furthermore, top housing 62 is typically flexible to allow activation of switch 67 by a user.

Illuminating element 64 is typically an LED, however other illuminating elements may be used as desired. Although two illuminating elements are shown in FIG. 9, it will be appreciated that any number of illuminating elements 64 may be utilized, as desired.

Bottom housing 70 typically includes a connecting structure 74 that is configured to connect to headwear 52, or other headwear. Connecting structure 74 typically includes apertures 76, that will allow illuminating device 60 to be connected to headwear.

Figure 10:
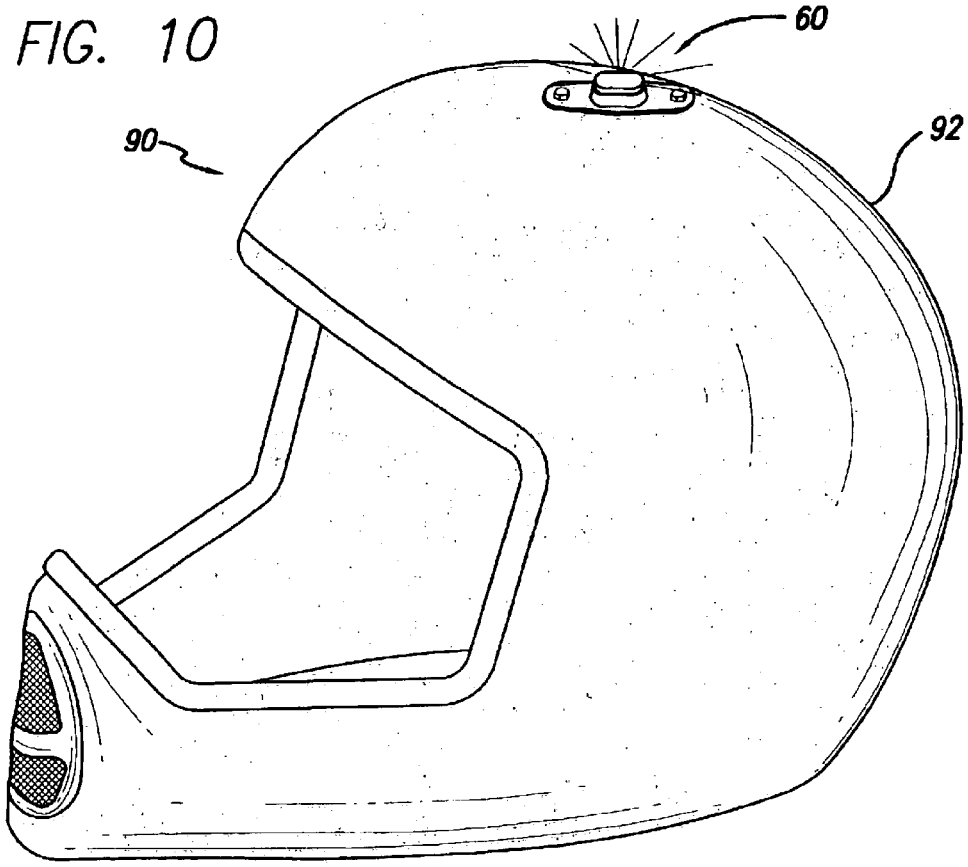
FIG. 10 is a perspective view, of yet another embodiment of lighted headwear according to the present invention.

FIG. 10 shows yet another embodiment of a lighted headwear system according to the present invention, generally at 90. Lighted headwear system 90 typically includes helmet 92 and illuminating device 60. In this embodiment, helmet 92 is a motorcycle helmet or other type of helmet.

Figure 11:
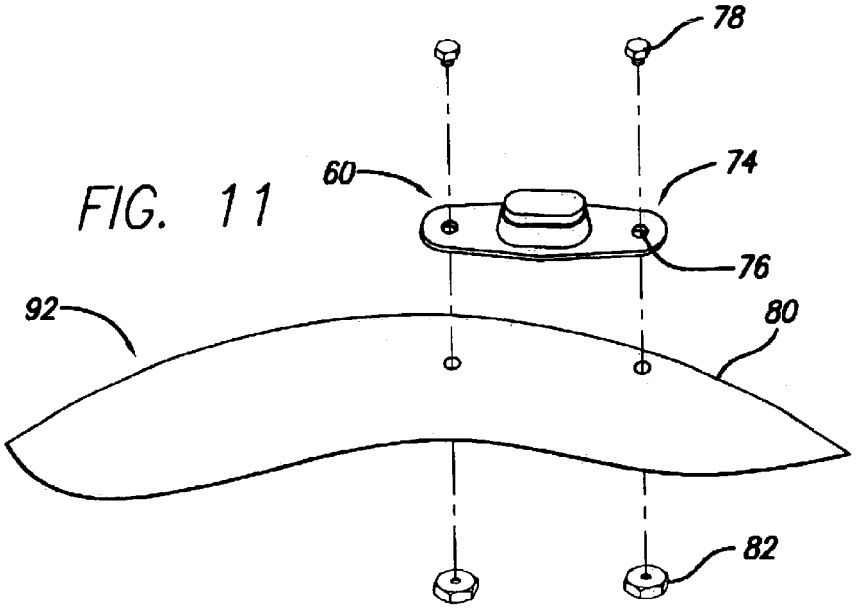
FIG. 11 shows a coupling configuration according to one embodiment of the present invention.

FIG. 11 shows a method of connecting illuminating device 60 to helmet 92 according to an embodiment of the present invention. Connecting structure 74 again includes aperture 76, and in this embodiment, bolts 78 extend through apertures 76 and surface 80 of helmet 92 and are secured to helmet 92 via nuts 82 that are threaded and configured to receive bolts 78. It will be appreciated that although nuts and bolts are shown as the method of fastening illuminating device 60 to helmet 92, other configurations may be utilized, including an adhesive, rivets, or other coupling configurations, as desired.

In all of the various embodiments depicted and disclosed, the illuminating device 60 may be such that the light entitled therefrom is emitted a full 360° therefrom or any lesser scale by way of shielding, as those of ordinary skill in the art will recognize.

While the present invention has been described with regards to particular embodiments, it is recognized that additional variations of the present invention may be devised without departing from the inventive concept. Thus, it is intended that the invention cover all embodiments and variations thereof as long as such embodiments and variations come within the scope of the appended claims and their equivalents.

What is claimed is:

1. An illuminated headwear, comprising:

a crown portion; and an illuminating device operatively coupled to said crown portion, said illuminating device including:

a first housing adapted to receive at least one illuminating element and at least one power source, said first housing having a crown interface portion, said crown interface portion being provided with at least one aperture; and a base having at least one prong adapted to mate with said at least one aperture such that a portion of said at least one prong extends away from said crown portion after mating, said extending prong portion being bent toward said crown portion by said at least one power source to secure said first housing to said crown portion as said at least one power source is being pushed in said first housing, said crown portion being securely sandwiched between said base and said crown interface portion of said first housing.

2. The illuminated headwear of claim 1, wherein said at least one prong portion is bent back away from said crown portion to decouple said first housing from said crown portion after said at least one power source is removed from said first housing.

3. The illuminated headwear of claim 1, further comprising a second housing configured for coupling to said first housing.

4. The illuminated headwear of claim 3, wherein said second housing includes a translucent portion.

5. The illuminated headwear of claim 4, wherein said translucent portion is adapted to transmit light within a substantially 360° range.

6. The illuminated headwear of claim 4, wherein said second housing further includes a control circuit operatively coupled between said at least one power source and said at least one illuminating element.

7. The illuminated headwear of claim 6, wherein said control circuit is energized by coupling said second housing tighter to said first housing.

8. The illuminated headwear of claim 1, wherein said at least one power source is a battery.

9. The illuminated headwear of claim 1, wherein said at least one illuminating element is a LED (Light-Emitting Diode).

10. The illuminated headwear of claim 1, wherein said crown portion has an inner surface and an outer surface, said base being disposed against said inner surface of said crown portion.

11. The illuminated headwear of claim 10, wherein said first housing is disposed against said outer surface of said crown portion.

12. The illuminated headwear of claim 11, wherein said first housing is secured to said base substantially at the apex of said outer surface of said crown portion.

13. The illuminated headwear of claim 1, wherein said crown portion is part of a baseball style cap.

* * * * *